US006412867B2

(12) United States Patent
Robinson

(10) Patent No.: US 6,412,867 B2
(45) Date of Patent: Jul. 2, 2002

(54) AUTOMATIC TWO SPEED MUSICAL ROCKING CHAIR

(76) Inventor: Odessa Robinson, 7206 Kedeon St., Pittsburgh, PA (US) 15208

( * ) Notice: Subject to any disclaimer, the term of this patent is extended or adjusted under 35 U.S.C. 154(b) by 0 days.

(21) Appl. No.: 09/798,533

(22) Filed: Mar. 1, 2001

Related U.S. Application Data

(60) Provisional application No. 60/185,790, filed on Feb. 29, 2000.

(51) Int. Cl.[7] ..... A47C 3/02

(52) U.S. Cl. ..... 297/260.2; 297/217.4; 297/184.1; 297/135

(58) Field of Search ..... 297/173, 153, 297/184.1, 258.1, 260.2, 260.1, 217.4, 135

(56) References Cited

U.S. PATENT DOCUMENTS 2,806,397 A * 9/1957 Nichols, Jr.
RE33,933 E * 5/1992 Hou
5,342,113 A * 8/1994 Wu
5,368,361 A * 11/1994 Wen-Ming
5,490,711 A * 2/1996 Pollock
5,860,698 A * 1/1999 Asenstorfer et al.
5,967,601 A * 10/1999 Gillins
6,017,085 A * 1/2000 LaCroix et al.
6,152,529 A * 11/2000 Beason

* cited by examiner

*Primary Examiner*—Milton Nelson, Jr.

(57) ABSTRACT

The present device is a two speed automatic rocking chair that plays one of six pre-programmed lullaby while it gently rocks the baby to sleep. A three position on/off switch and a multi-position selector switch for choosing a lullaby are located beneath the seat on the rear of the rocking chair. A rechargeable battery powers a small electric motor which rocks the rocking chair. The battery may be removed as required and recharged with a counter-top battery charger. A removable canopy shields the infant and a removable tray may be installed to provide a surface whereby toys may be placed for the infant to play with.

8 Claims, 5 Drawing Sheets

AUTOMATIC TWO SPEED MUSICAL ROCKING CHAIR

RELATED APPLICATIONS

The present invention is a Continuation of U.S. Provisional Application No. 60/185,790, filed on Feb. 29, 2000.

BACKGROUND OF THE INVENTION

1. Field of the Invention

The present invention relates generally to musical rocking chair devices and, more particularly, to an automatic, electrical, two-speed musical rocking chair.

2. Description of the Related Art

Infants and newborns love to be rocked to sleep. Whether it is the arms of an adult or in an infant swing, the methodic movement just works magic on fussy or crying babies. As the child grows older, they may outgrow the swing or being held by an adult, but they still like to be rocked. Options for them at this point include using an adult rocker, but their feet cannot often reach the floor. Sitting with an adult in a rocker is an option also, but requires that a parent or other person sit with them to produce the rocking motion. Accordingly, the need has developed for a means by which small children can be rocked to sleep without requiring the constant attention of their parents to produce the rocking motion. The development of the Automatic Two Speed Musical Rocking Chair fulfills this need.

Within the related art, numerous applications exist for manually operated rocking chairs incorporating musical reproducing devices. However, a need has been felt for providing a means by which small children can be rocked to sleep without requiring the constant attention of their parents to produce the rocking motion.

Accordingly, there is a need for a means for providing a rocking chair that automatically rocks and plays musical lullabies thereby allowing children to be rocked to sleep without effort and eliminating the need for direct parent interaction.

In the related art, U.S. Pat. No. D366,677 issued in the name of Patterson claims a child's rocking toy in a caricature of a dinosaur.

U.S. Pat. No. RE 33,933 issued in the name of Hou discloses a toy music rocking chair for a doll.

U.S. Pat. No. 5,490,711 issued in the name of Pollock discloses a musical rocking chair for a child but without batteries or electricity.

U.S. Pat. No. 5,143,055 issued in the name of Eakin discloses a somatic acoustic non-rocking chair for a child or adult.

U.S. Pat. No. 4,064,376 issued in the name of Yamada discloses a vibrating sound reproduction chair for adult or child.

U.S. Pat. No. 4,055,170 issued in the name of Nohmura discloses a chair or bed with sound and acoustical vibrations to promote health..

U.S. Pat. No. 4,022,566 issued in the name of Martinmaas discloses a chair or bed with various speakers producing sound, timbre control and sonic vibrations.

U.S. Pat. No. 2,806,397 issued in the name of Nichols discloses a musical rocking chair for adult/child whereby rocking motion produces music.

U.S. Pat. No. 2,623,430 issued in the name of Hassllon discloses nearly the same invention as in U.S. Pat. No. 2,806,397 issued in the name of Nichols but with switch selectability for on/off.

U.S. Pat. No. 2,519,782 issued in the name of Mueller et al discloses a method of incorporating a non-battery/electrical "swiss styled" music box into juvenile furniture including a rocking chair.

While musical rocking chair devices are incorporated into this invention in combination, other elements are different enough as to make the combination distinguished over this related art.

Consequently, a need has therefore been felt for an improved but less complex mechanism that automatically rocks and plays musical lullabies thereby allowing children to be rocked to sleep without effort and eliminating the need for direct parent interaction.

SUMMARY OF THE INVENTION

It is therefore an object of the present invention to provide an improved musical rocking chair that automatically rocks and automatically plays musical lullabies.

It is a feature of the present invention to provide mechanical action to a reciprocating mechanism by an electric motor.

It is another feature of the present invention to provide power to the electric motor by a battery pack.

It is still another feature of the present invention to provide the soothing comfort of rocking in a rocking chair for babies and toddlers which allows them to quickly and easily fall asleep with gentle rocking motions as well as soothing music.

Briefly described according to the preferred embodiment of the present invention, the Automatic Two Speed Musical Rocking Chair, as its name implies, is an automatic rocking chair for babies and toddlers. The rocking chair itself is of a small size so children can easily sit in it. Located beneath the seat of the rocking chair is a reciprocating mechanism which forces the chair back and forth with reference to the floor upon which it sits. The reciprocating mechanism is powered by a small electric motor which receives power from a battery pack. Such a mechanism would have a switch to allow for movement at two speeds. The battery also powers a music box comprised of a microchip preprogrammed with six popular lullabies to help the child sleep as well. Such a device is especially suited for older children who may have trouble falling asleep, but are too old or big to fit into an infant swing. After the child has fallen asleep, he or she may be placed in a bed or crib where they will be safe for the rest of their sleep or nap. The use of the Automatic Two Speed Musical Rocking Chair provides the soothing comfort of rocking in a rocking chair for babies and toddlers which allows them to quickly and easily fall asleep with gentle rocking motions as well as soothing lullabies.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1–5.

1. Detailed Description of the Figures

Figure 1:
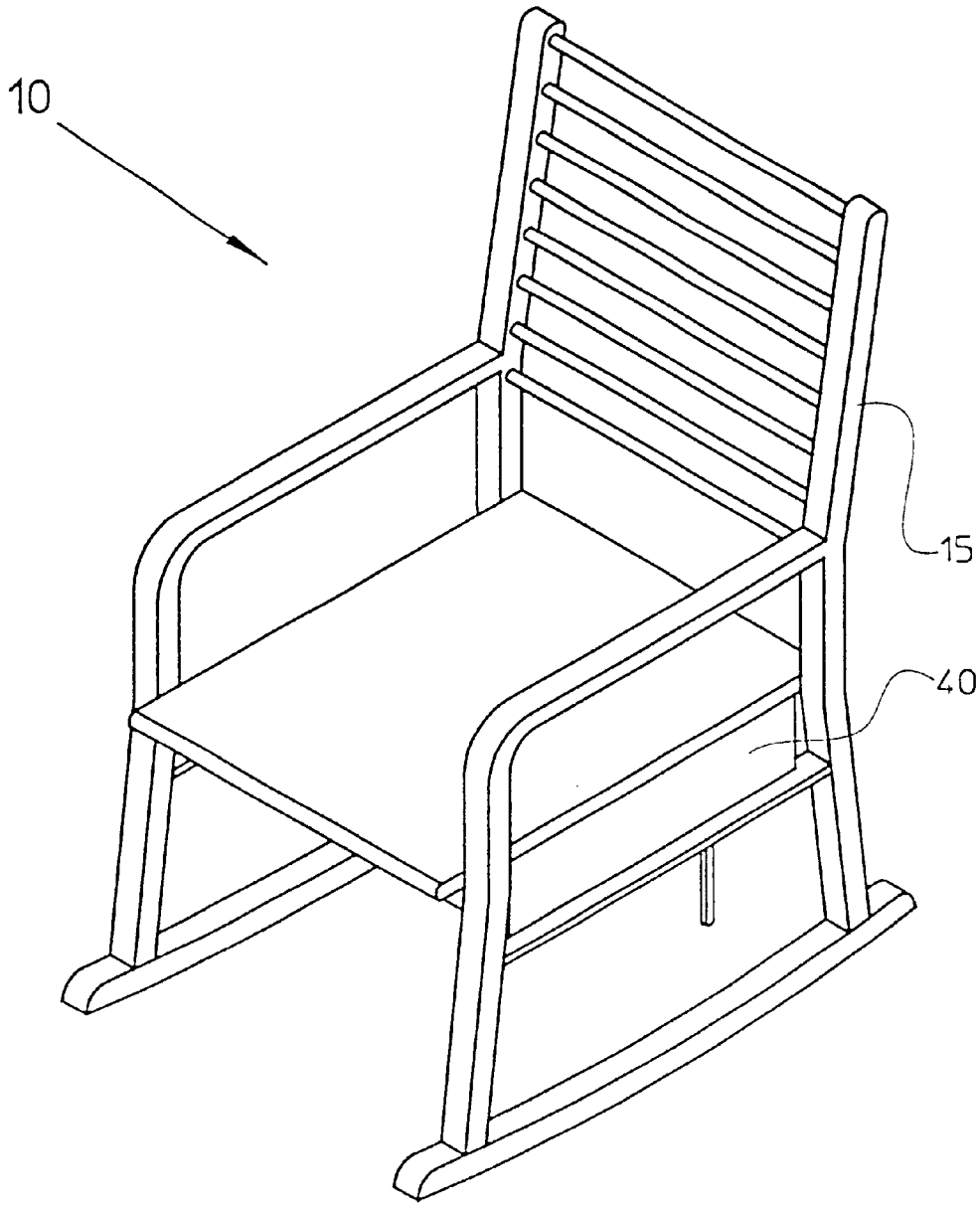
FIG. 1 is a perspective view of the Automatic Two Speed Musical Rocking Chair, according to the preferred embodiment of the present invention.
Figure 2:
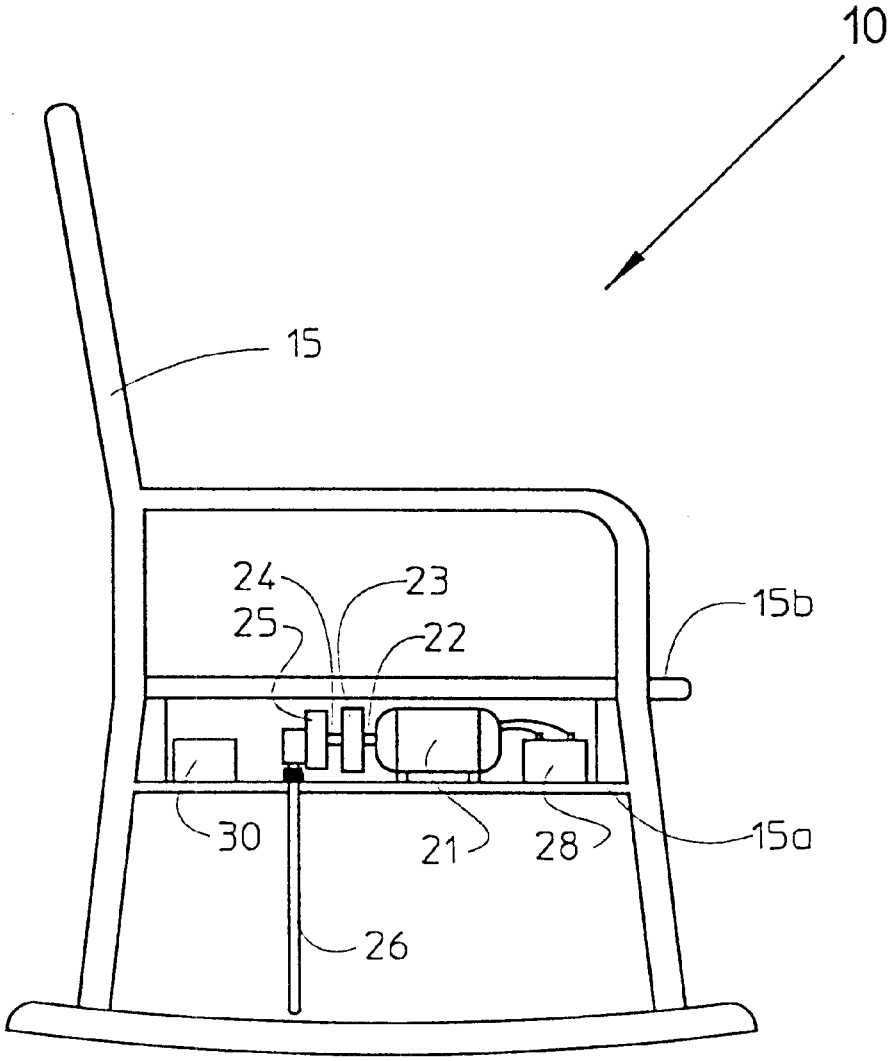
FIG. 2 is a right side view of a Automatic Two Speed Musical Rocking Chair with the access panel to the rocking mechanism and music box removed, according to the preferred embodiment of the present invention.

Referring now to FIGS. 1 and 2, an Automatic Two Speed Musical Rocking Chair 10 is shown, according to the present invention, comprised of a rocking chair 15 and a rocking means 20, a music box 30, a rechargeable battery 28, a three position on-off switch 30*c* all residing on the inside of a housing 40. The housing 40 is of a rectangular configuration resting on top of a housing support member 15*a* and resting underneath a seat 15*b* of rocking chair 15 being of a size adapted for the seating of young children. Housing support member 15*a* is of such dimensions to yield sufficient strength to accommodate the weight of said housing 30. Rotatably connected to rocking means 20 is a rocking rod 26 for transmitting the linearly translating motion created by a rocking means 20. In an alternate embodiment, rocking chair 15 can be fitted with a removable canopy to shield the infant seated therein. A removable tray may also be fitted and attached via suitable means to the front of rocking chair 15 to provide a surface where the infant may be fed or provided with toys to play with.

Rocking means 20 comprises an electric motor 21 which generates rotational power necessary for rocking chair 15. Electric motor 21 and music box 30 is powered by a battery pack 28 which is removably inserted into a specially formed cavity in housing 40. Connected to the posterior end of electric motor 21 is a first shaft 22 being of a linearly elongated laterally extending cylindrical configuration. First shaft 22 couples the rotational power of electric motor 21 to a gear box 23 which converts the high RPM, low torque of electric motor to a low RPM, high torque output which is desirable for rocking chair 15. This is accomplished by converting this output to a linearly and vertically translating motion via a cam 25 coupled to the output of gearbox 25 via a second shaft 24.

The output side of cam 25 is generally elliptical in shape for pushing rocking rod 26 in a generally downward direction. Rocking rod 26 is attached directly beneath the output side of cam 25 so that the top end of rocking rod 26 will contact the elliptical portion of cam 25. Rocking rod 25 is kept in constant contact with the elliptical portion of cam 25 by a spring 26*a* biasing rocking rod 26 upward. A specially formed guide socket 40*a* in the bottom of housing 40 supports and permits rocking rod 26 to protrude through the bottom of housing 40. As the elongated portion of cam 25 rotates toward it's lowermost position, rocking rod 26 is forced downward toward it's lowermost position. The length of rocking rod 26 is designed so when in it's lowermost position, it's lower end contacts the surface the rocking chair 15 is resting on. Rocking rod 26 when in this position applies an upward external force on the frame of rocking chair 15 forcing the rear of rocking chair 15 upward. As the cam continues through it's rotation, rocking rod 26 is pulled upwardly by spring 26*a* and the upward force on rocking chair 15 is relaxed. As a result, the rear of rocking chair 15 begins to fall under the force of gravity. The momentum of the falling chair will cause the chair to rock slightly backward until the natural righting moment of the chair begins to rock the chair back to its at rest position. However, cam 26 continues through its rotation and begins to push rocking rod 26 downwardly and again raise the rear end of rocking chair 15. This cycle continues as long as the power to electric motor 21 is switched on.

Figure 3A:
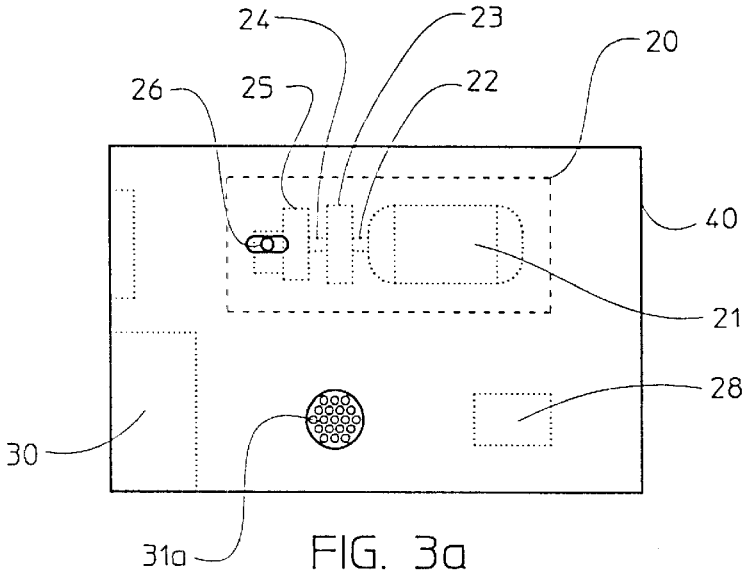
FIG. 3*a* is a bottom view of a rocking mechanism and music box from an Automatic Two Speed Musical Rocking Chair, according to the preferred embodiment of the present invention.
Figure 3B:
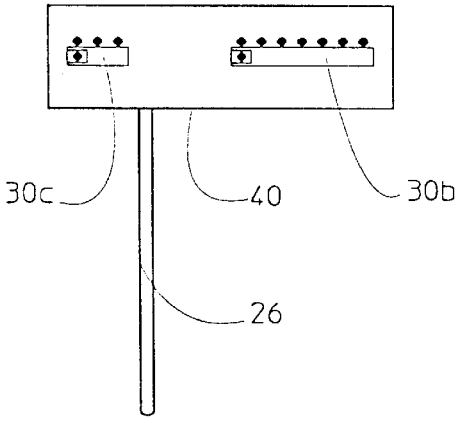
FIG. 3*b* is a rear side view of a rocking mechanism and music box from an Automatic Two Speed Musical Rocking Chair with the rear panel removed, according to the preferred embodiment of the present invention.
Figure 4:
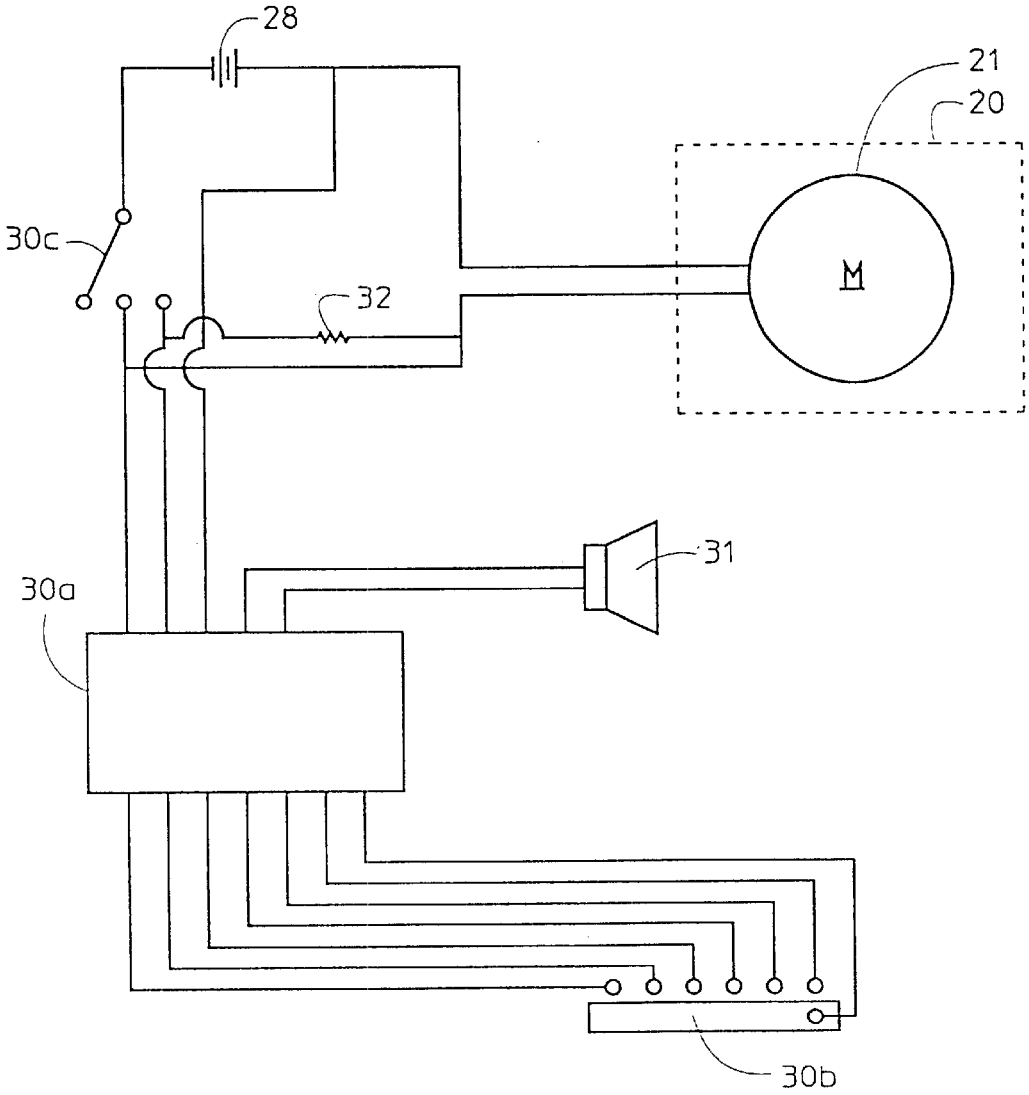
FIG. 4 is an electrical schematic of the music box and rocking means from an Automatic Two Speed Musical Rocking Chair, according to the preferred embodiment of the present invention.

The automatic rocking motion and the automatic playing of music is effectuated by means of a three-speed switch 30*c* (shown in FIG. 3*b* in the rear sidewall and in FIG. 4 in the electrical schematics). The three-speed switch 30*c* comprises a means for turning the present invention off and on and consists of low speed and medium speed. FIG. 3*b* also shows located in the rear sidewall of housing 40 a seven-position switch 30*b* that allows a user to select one of six pre-programmed lullabies from an IC chip 30*a* or a mute position.

Figure 3C:
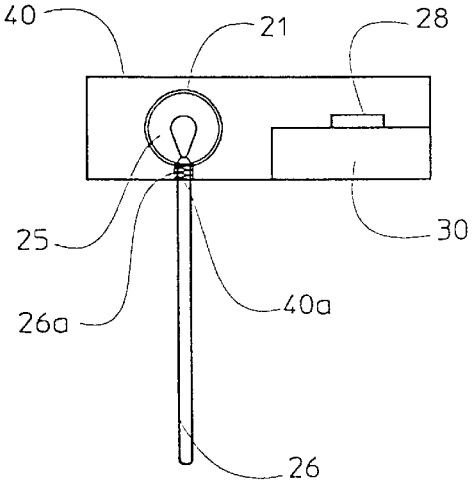
FIG. 3*c* is a rear side view of a rocking mechanism and music box from an Automatic Two Speed Musical Rocking Chair with the rear panel removed, according to the preferred embodiment of the present invention.

Now referring to FIG. 3*a*, shown is a bottom view of housing 40 showing the placement of rocking means 20, music box 30, rechargeable battery 28, a three position on-off switch 30*c*, and a speaker grill 31*a* located on the surface of the bottom sidewall. Rocking means 20 for purposes of disclosure consists of motor 21, first shaft 22, gear box 23, second shaft 25, and cam 25. Electric motor 21 is a direct current motor with a voltage rating between 6 to 12 volts. Seven position switch 30*b* is located integrally within music box 30 and positioned such that it faces to the rear of housing 40 and can be accessed through a rectangular aperture in the rear sidewall of housing 40 as shown in FIG. 3*b*. Three-position switch 30*c* is located similarly facing toward the rear of housing 40 and accessed through a rectangular aperture in the rear sidewall of housing 40 as shown in FIG. 3*b*. FIG. 3*c* is a rear view of housing 40 with the rear sidewall removed to show the placement of rocking means 20, rocking means 20, music box 30, rechargeable battery 28, three position on-off switch 30*c*, and rocking rod 26 protruding through the bottom sidewall of housing 40 through guide socket 40*a*. Shown in detail is rocking rod 26 biased upward by spring 26*a* located in guide socket 40*a* against cam 25. Motor 21 can be seen directly behind and adjacent to cam 25.

Finally, referring now to FIG. 4, an electrical schematic from an Automatic Two Speed Musical Rocking Chair 10 is shown. A rechargeable battery 28 supplies power to a direct current electric motor 21 which provides the mechanical power to rock rocking chair 15. Rechargeable battery 28 can be removed from housing 40 via a removable panel (not shown) in the sidewall of housing 40. Rechargeable battery 28 can then be recharged with a conventional counter-top battery charger (not part of the disclosure). Power to electric motor 21 is selectively isolated by a three-position switch 30*c*. In the first position, now current can flow to electric motor 21 or IC chip 30*a*. In the second position, full current can flow to electric motor 21 and IC chip 30*a*. In the third position, current can flow to electric motor 21 but a resistor 32 placed in series on the power lead to electric motor 21 causes a voltage drop across electric motor 21 causing electric motor 21 to operate at a slower speed. Full current still flows to IC chip 30*a* via a separate power lead. In this fashion, when three position switch 30c is in the second and third position, power is supplied to IC chip 30*a* so that one of six pre-programmed lullabies will be played through speaker 31. A seven-position switch 30*b* connected to IC chip 30*a* allows a user to select which of the lullabies is to be played. A position on seven-position switch 30*b* signals IC chip 30*a* to be mute.

Figure 5:
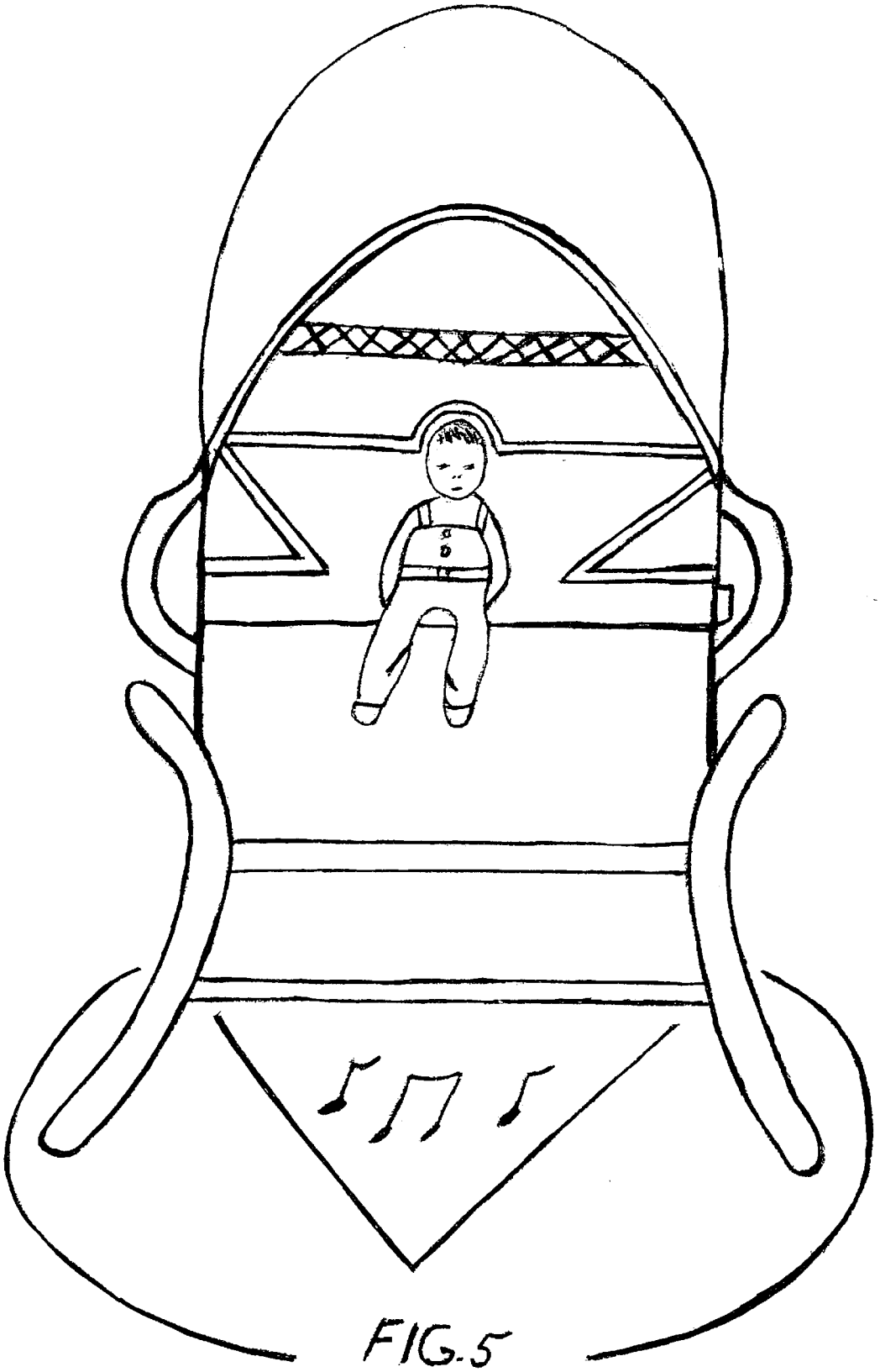
FIG. 5 is a front perspective view of an alternate embodiment thereof.

Referring now to FIG. 5, and alternate embodiment of an Automatic Two Speed Musical Rocking Chair 10 is shown, in which a number of optional features are indicated. These include a removable canopy that encloses a headrest, a removable tray provide with receiving means for attaching toy protuberance, as well as a frame that provides for a swing-like operation when used with infants of a younger age that are unable to support themselves. As such, the features and improvements described above can be provided in combination with such a configuration.

2. Operation of the Preferred Embodiment

To use the present invention, one simply places an infant in the seat of the rocking chair. A special harness is then used to strap the infant in the chair. A removable canopy top may then be installed to shield the infant. Likewise, a removable tray may then be installed to provide a surface where toys may be placed for the infant to play with. The chair me then be set to rock automatically by selecting one of two speeds on a selector switch located on a housing beneath the seat in the back of the chair. One of six pre-programmed lullabies may also be played by sliding a selector switch also located beneath the seat behind the chair to the appropriate position. A rechargeable battery powers a small electric motor which can be removed for charging as required.

The foregoing description is included to illustrate the operation of the preferred embodiment and is not meant to limit the scope of the invention. The scope of the invention is to be limited only by the following claims.

What is claimed is:

1. An automatic, electrical, musical rocking chair comprising:

a rocking chair having a seat and rocking means for creating a rocking motion relative to said seat;

a music box having a rechargeable battery for providing electrical energy to produce music;

a three position on-off switch residing on the inside of a housing, said housing of a rectangular configuration resting on top of a housing support member and resting underneath said seat, and a rocking rod, said rocking rod rotatably connected to said rocking means for transmitting a linearly translating motion created by said rocking means.

2. The automatic, electrical, musical rocking chair of claim 1, further comprising a removable canopy affixed above said seat to shield an occupant seated therein.

3. The automatic, electrical, musical rocking chair of claim 1, further comprising a removable tray attached to said rocking chair to provide a surface reachable to an occupant.

4. The automatic, electrical, musical rocking chair of claim 1, wherein said rocking means comprises an electric motor which generates rotational power applied to said rocking chair, said electric motor powered by said rechargeable battery, and wherein connected to a posterior end of said electric motor is a first shaft being of a linearly elongated laterally extending cylindrical configuration, said first shaft for coupling the rotational power of said electric motor to a gear box which converts high RPM, low torque of said electric motor to a low RPM, high torque output by converting the linearly translating motion and a vertically via a cam coupled to the output of said gearbox via a second shaft.

5. The automatic, electrical, musical rocking chair of claim 4, wherein an output side of said cam is generally elliptical in shape for pushing a rocking rod in a generally downward direction, said rocking rod being attached directly beneath the output side of said cam so that the top end of said rocking rod will contact the elliptical portion of said cam.

6. The automatic, electrical, musical rocking chair of claim 5, wherein said rocking rod is kept in constant contact with the elliptical portion of said cam by a spring biasing said rocking rod upward, and wherein a formed guide socket supports and permits said rocking rod to protrude through the bottom of said housing.

7. The automatic, electrical, musical rocking chair of claim 6, wherein automatic rocking motion and automatic playing of music is effectuated by means of said three position switch, said three position switch comprising means for turning said motor off and on, means for turning said motor to a low speed and means for turning said motor to a medium speed.

8. The automatic, electrical, musical rocking chair of claim 1, wherein said music box allows a user to select one of six pre-programmed lullabies from an IC chip.

* * * * *